US007853165B2

(12) United States Patent
Davidson et al.

(10) Patent No.: US 7,853,165 B2
(45) Date of Patent: Dec. 14, 2010

(54) APPARATUS AND METHOD FOR A MULTI-TAP SERIES RESISTANCE HEATING ELEMENT IN A BELT FUSER

(75) Inventors: Malcolm Davidson, Fairport, NY (US); Brian Gillis, Rochester, NY (US); Robert Tuchrelo, Williamson, NY (US); Nathan Smith, Hamlin, NY (US); Scott Potter, Welwyn Garden (GB); John Washington, Hitchin (GB); Peter Cresswell, Welwyn (GB)

(73) Assignee: Xerox Corporation, Norwalk, CT (US)

( * ) Notice: Subject to any disclaimer, the term of this patent is extended or adjusted under 35 U.S.C. 154(b) by 67 days.

(21) Appl. No.: 12/327,852

(22) Filed: Dec. 4, 2008

(65) Prior Publication Data

US 2010/0142986 A1 Jun. 10, 2010

(51) Int. Cl.
*G03G 15/20* (2006.01)

(52) U.S. Cl. ..... 399/69; 399/334

(58) Field of Classification Search ..... 399/69, 399/328, 330, 334; 347/156; 219/216, 255, 219/470

See application file for complete search history.

(56) References Cited

U.S. PATENT DOCUMENTS

| | | | | |
|---|---|---|---|---|
| 6,091,059 | A * | 7/2000 | Sato et al. | 219/216 X |
| 6,298,215 | B1 * | 10/2001 | Nomura et al. | 399/328 |
| 6,336,027 | B1 * | 1/2002 | Sakai et al. | 399/328 |
| 6,850,728 | B2 * | 2/2005 | Yokozeki et al. | 399/328 |
| 7,228,082 | B1 | 6/2007 | Davidson et al. | |
| 7,565,103 | B2 * | 7/2009 | Chae et al. | 399/334 |
| 2004/0228667 | A1 * | 11/2004 | Eskey | 399/334 |
| 2007/0237536 | A1 * | 10/2007 | Roof et al. | 399/69 |

FOREIGN PATENT DOCUMENTS

JP 04-181979 A * 6/1992

* cited by examiner

*Primary Examiner*—Sophia S Chen
(74) *Attorney, Agent, or Firm*—Fay Sharpe LLP

(57) ABSTRACT

A segment and heater fuser roll is disposed for a printing device including a plurality of heating elements in a preselected order relative to a voltage return. A plurality of voltage taps are disposed for applying selected power to ones of the plurality of heater elements. The heater elements vary in power density per unit length.

8 Claims, 4 Drawing Sheets

APPARATUS AND METHOD FOR A MULTI-TAP SERIES RESISTANCE HEATING ELEMENT IN A BELT FUSER

FIELD OF INVENTION

This invention relates generally to electrostatographic reproduction machines, and particularly a fuser adapted to handle different paper widths.

BACKGROUND

In a typical electrostatographic reproduction process machine, a photoconductive member is charged to a substantially uniform potential so as to sensitize the surface thereof. The charged portion of the photoconductive member is imagewise exposed in order to selectively dissipate charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated at a thermal fusing apparatus at a desired operating temperature so as to fuse and permanently affix the powder image to the copy sheet.

In order to fuse and fix the powder toner particles onto a copy sheet or support member permanently as above, it is necessary for the thermal fusing apparatus to elevate the temperature of the toner images to a point at which constituents of the toner particles coalesce and become tacky. This action causes the toner to flow to some extent onto the fibers or pores of the copy sheet or support member or otherwise upon the surface thereof. Thereafter, as the toner cools, solidification occurs causing the toner to be bonded firmly to the copy sheet or support member.

U.S. Pat. No. 7,228,082 discloses a belt fuser having a multi-Tap heating element, the disclosure of which is incorporated herein by reference in its entirety.

FIG. 1 is an enlarged schematic cross-sectional view of a typical belt fuser heater element comprised of a thermally conductive ceramic substrate layer 8, a low friction coating layer 7, having a conductor/heater interfaced thereon; and conductive resistive traces 4, 5 and 6; and a ceramic glazing electrical insulation layer 10. Power delivered to the heating elements 4, 5 and 6 causes them to heat up and the heat is then transferred through the thermally conductive ceramic substrate 8 and the low friction coating layer 7 to the belt. The heating elements are electrically isolated by the ceramic glazing 10.

FIG. 2 is a schematic diagram of a segmented ceramic heater wherein Segment 1, Segment 2 and Segment 3 correspond respectively to heating elements 4, 5 and 6 of FIG. 1. It can be seen that the heater is heated by applying voltage to one of three taps $V_1$, $V_2$, $V_3$ along the resistive trace comprised of $R_1$, $R_2$ and $R_3$. The voltage tap is selected when a thermistor detects a segment is under temperature. The control algorithm ensures that switching is done by a hierarchy starting at the last segment (furthest from the return tap, $V_3$). If the resistances/unit length are even, the controls are generally acceptable. If the resistances are not even, such as the last segment is under powered, that segment cannot keep up because it cannot be independently controlled. In other words, only Segment 1 can be independently controlled when a voltage is applied to voltage tap $V_1$, while when voltage is applied at $V_2$, power is applied to both segment 1 and segment 2, and when voltage is applied at $V_3$, all segments receive energy. A key metric is power per unit length (W/mm). To use the segmented heater of FIG. 2, under series hierarchy control, the heater must be designed such that each subsequent segment is of a higher resistance than the previous. This ensures the series controlled segment is not under powered.

Prior art belt fusers are designed such that $R_1$, $R_2$, $R_3$ and $V_1$, $V_2$ and $V_3$ have selected values wherein $W/mm_1=W/mm_2=W/mm_3$. To maintain temperature uniformity, all segments are controlled to the same set point temperature. The power is distributed by powering $V_3$ to return (RTN) when segment is low, else $V_2$ to RTN when Segment 2 is low, else powering $V_1$ RTN when segment 1 is low.

A particular problems results if manufacturing tolerances of the belt fuser heating elements allow $R_3$ to be low and subsequently $W/mm_3$ to be lower than $W/mm_2$, and thus the temperature of Segment 3 would be too low and would not recover because it cannot be powered independent of Segment 1 and Segment 2.

In other words, as noted above, the Segments are respectively sized to match the sheets being run in the printing machine. (That is, Segment A is sized to match A5, Segments 1+2 match 8.5×11 letter short edge and Segments 1+2+3 match A4 long edge.) Segment A is switched on nearly continuously and Segments B and C would be switched on according to larger paper sizes being run. Typically, Segment B is run in combination with Segment A when A4 short edge paper is being run and Segments A, B and C are switched on when A3 or A4 long edge sheets are being run. Thus, if running A4 short edge sheets, A+B would be switched on and Segment C would be relatively cool. If A3 sheets are to be run directly after, Segment C has to be heated. But to heat Segment C, then Segments A+B+C must be series connected and by the time Segment C is running a temperature, Segments A and B have already increased well above what is needed.

Thus, there is a need for a multi-tap series resistance ceramic heater functioning as a belt fuser that can ensure that all composite segments can be maintained at a desired operating temperature.

DETAILED DESCRIPTION

Figure 1:
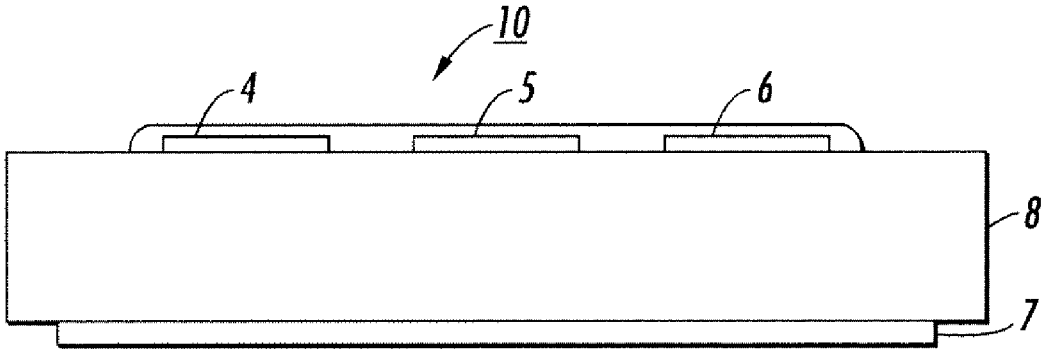
FIG. 1 is an enlarged schematic cross-sectional view of a belt fuser heater.
Figure 2:
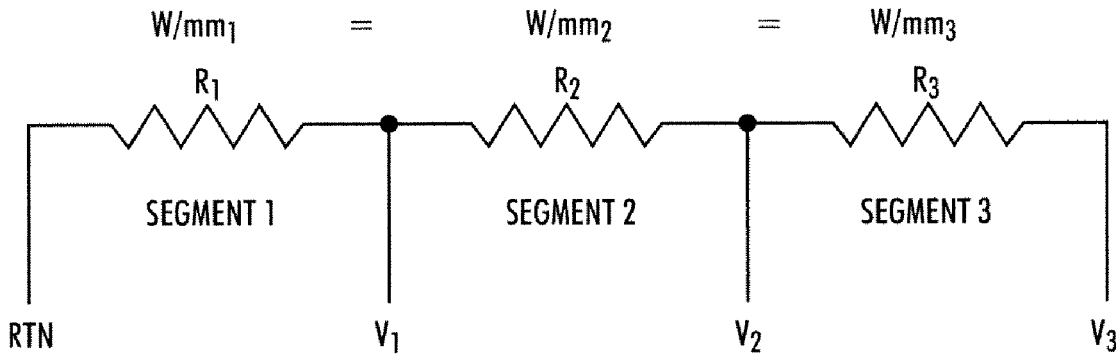
FIG. 2 is a schematic of a multi-segment heater wherein each of the segments has approximately the same power density per unit length.
Figure 3:
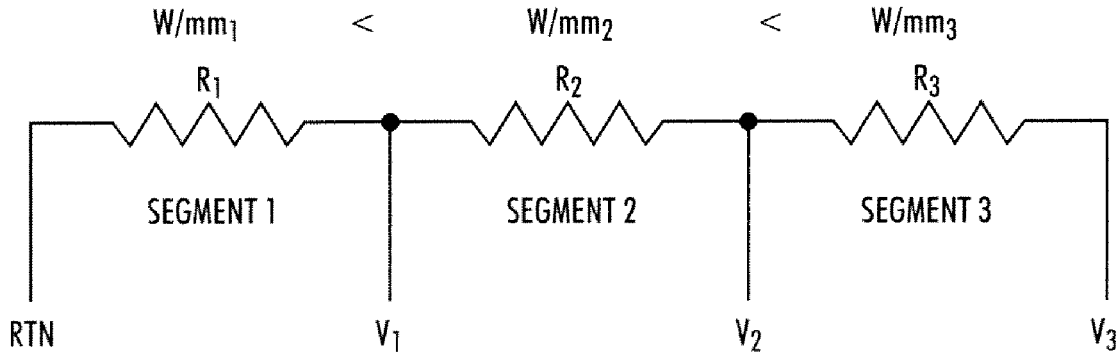
FIG. 3 is a schematic of a multi-segment belt fuser wherein segment heater elements have different power densities per unit length.

With particular reference to FIG. 3, an embodiment is disclosed comprising a heater fuser roll for a printing device (not shown) including a plurality of heating elements, $R_1$, $R_2$, $R_3$ comprising roll segments and having a preselected order related to a voltage RTN. A plurality of voltage taps $V_1$, $V_2$, $V_3$ for selected power application to ones of the plurality heater elements are interposed between the heater elements as a plurality of Segments 1, 2 and 3 as noted above. However, the Segments vary in power density per unit length ("W/mm") in that the power density per unit length of Segment 1 is less than the power density per unit length of Segment 2, which in turn is less than the power density per unit length of Segment 3. The higher the power density per unit length, the faster the temperature will rise in a heating element. In such an embodiment, when the voltage is applied to voltage tap $V_3$ so that heating elements $R_1$, $R_2$, $R_3$ are all effectively in series, Segment 3 will heat up faster than Segment 2 or Segment 1, or in other words, Segments 1 and 2 will not overheat by the time Segment 3 has reached its desired temperature.

In the embodiment of FIG. 3, the power/length of the fuser is controlled to ensure that Segment N always rises faster than Segment N−1, ensuring Segment N cannot be under temperature. As for the construction of the respective segment traces comprising the heater elements, the resistances of the segment traces must be controlled to achieve the aforementioned variable power density per unit length requirements. Current is determined by $V_3/(R_1+R_2+R_3)$ and from that each of the resistances can be determined. From that the resistivity of the segments can be determined. The structural embodiments require either a change in resistivity of the inks for each segment, or a change in the width of each segment (i.e., the trace of Segment 1 is wider than the trace of Segment 2, which in turn is wider than the trace of Segment 3). Alternatively, a change in the thickness of each segment could also provide variable power density per unit length (i.e., the thickness of the trace of Segment 1 is greater than the thickness of the trace of Segment 2, which in turn is greater than the thickness of the trace of Segment 3).

Figure 4:
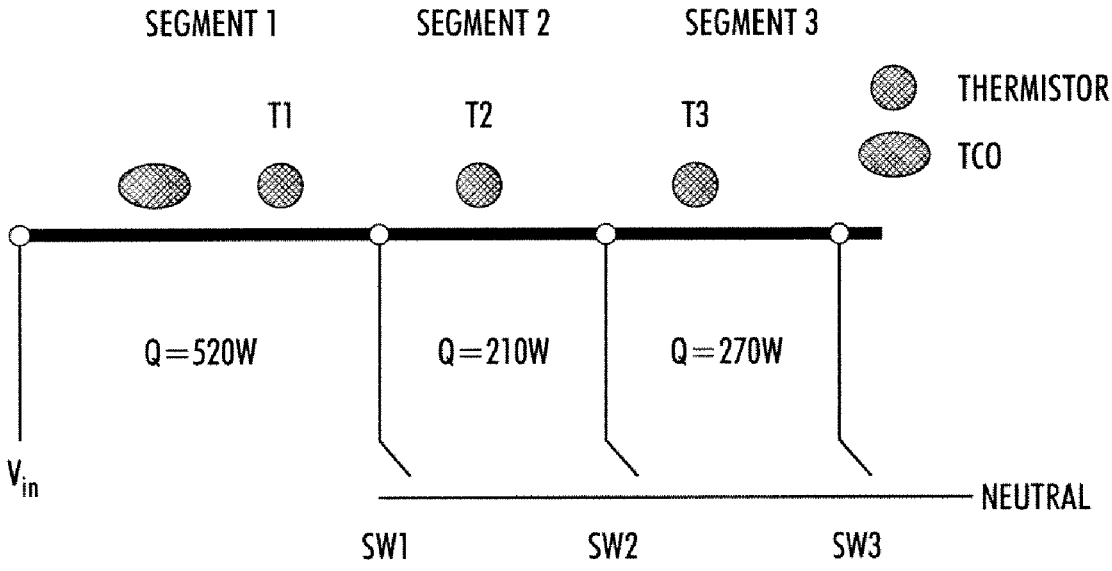
FIG. 4 is an alternative embodiment of a fuser belt heater assembly.
Figure 5:
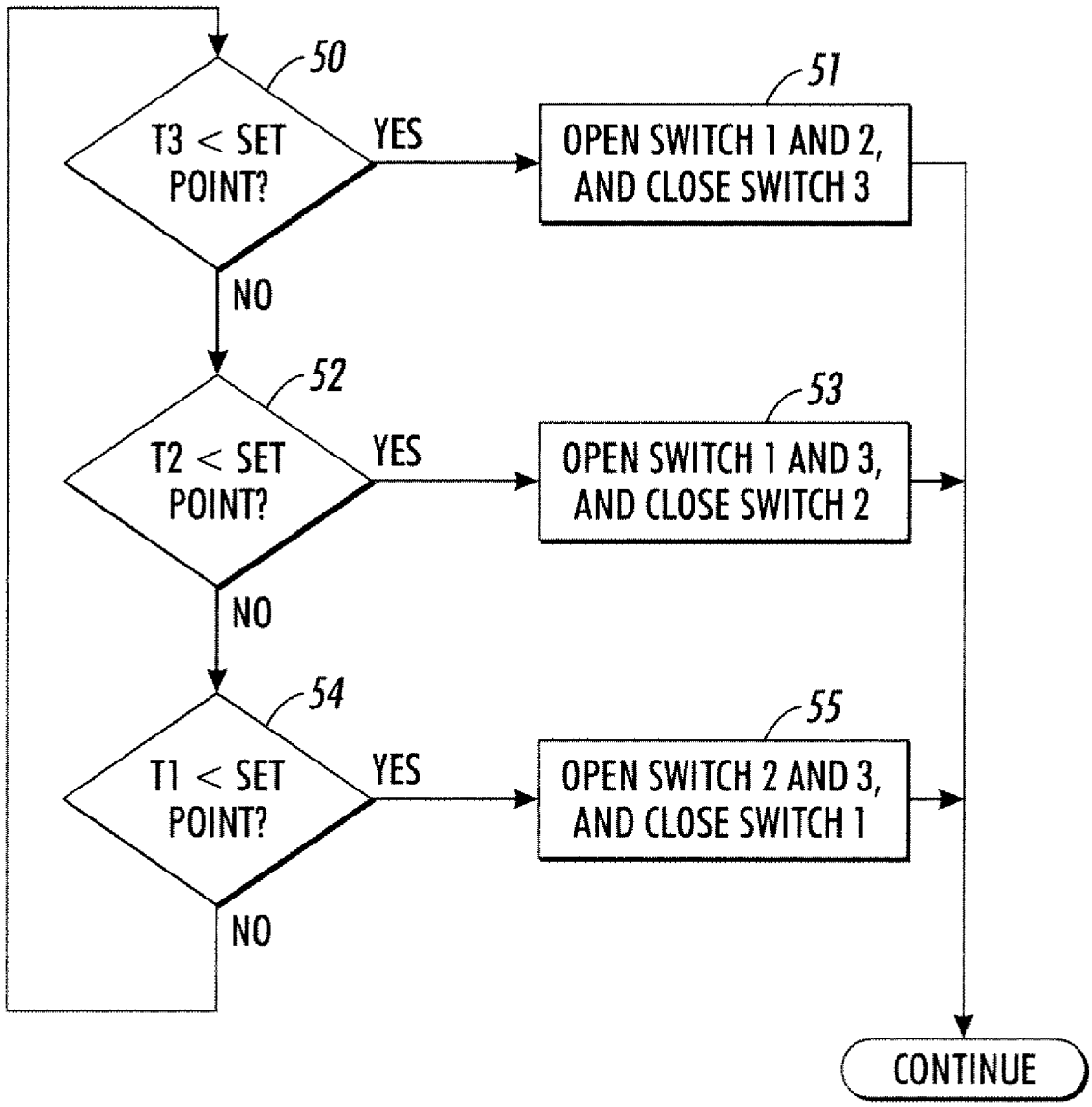
FIG. 5 is a flowchart specifying a circuit of switching steps.

With particular reference to FIGS. 4 and 5, an alternative embodiment is comprised, wherein a single voltage tap $V_{in}$ is provided and the segments are arranged in series with selected power application controlled by a plurality of switches SW1, SW2, SW3 to a Neutral. In this embodiment, it can be seen that each segment has variable power density per unit length where Segment 1 has a Q of 520 watts, Segment 2 has a Q of 210 watts, and Segment 3 has a Q of 270 watts. Only Segment 1 has a thermal cutoff controller (TCO), while the temperature of each Segment is monitored by thermistors T1, T2, T3, respectively. If the temperature/heat level of any of the segments is less than the desired set point, then the switches can be operated to particularly direct energy to the segments in a manner wherein the low temperature segment can be properly heated without an excessive rise in the temperature in the other segments. More particularly, it can be seen that if the temperature of Segment 3, T3 is less than a set point 50, then Switches 1 and 2 are opened and Switch 3 is closed 51. If the temperature of Segment 2 T2 is less than the set point 52 then Switches 1 and 3 are opened and Switch 2 is closed 53, while if Segment 1's temperature T1 is less than the desired set point 54 then Switches 2 and 3 are opened and Switch 1 is closed 55. Although it can be appreciated that when Switches 2 or 3 are less than set point, T1 and T2 may be an appropriate temperatures and will receive further energy upon the closing of Switch 3. However, since Segment 3 has a higher power density per length, its temperature will be raised faster than either Segment 1 or Segment 2 so that it can achieve a desired temperature without overheating Segments 1 and 2.

Various alternative embodiments may be envisioned that are equivalent to the subject embodiments including varying the voltage at the taps of FIG. 3 in a manner similar to ensure that Segment 3's temperature rise will occur at a faster rate when its temperature is below a desired set point, without excessively rising the temperatures of Segments 1 and 2.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A segmented-heater fuser roll for a printing device including:

a plurality of heating elements having a preselected order relative to a voltage return; and a plurality of voltage taps for selective power application to ones of the plurality of heater elements, wherein selected ones of the heater elements vary in power density per unit length, wherein the preselected order comprises heating elements having a relatively higher power density per unit length being disposed further from the voltage return.

2. The fuser roll of claim 1 wherein each of the plurality of heater elements has a different power density per unit length.

3. The fuser roll of claim 1 wherein the plurality of voltage taps are disposed intermediate adjacent ones of the heater elements.

4. The fuser roll of claim 3 wherein the voltage taps supply equivalent voltages.

5. A method for operating a belt fuser in a printing device comprised of a plurality of heater segments having varying power density per unit lengths, for avoiding selective segment overheating, including:

disposing the heater segments in series wherein a first segment has a lesser power density per unit length than an adjacent segment; and switching power to the adjacent segment upon detection that the adjacent segment has a temperature less than a set point, wherein the temperature in the adjacent segment will rise faster than the first segment.

6. The method of claim 5 wherein the switching power comprises connecting any of the plurality of segments to a common voltage input.

7. A segmented-heater fuser roll for a printing device including:

a plurality of heating elements having a preselected order relative to a voltage return; and a plurality of voltage taps for selective power application to ones of the plurality of heater elements, wherein selected ones of the heater elements vary in power density per unit length, wherein N heater elements are included in the fuser roll, and a first heater element is disposed adjacent the voltage return and the Nth heater element is farthest from the voltage return, and wherein the power density per unit length of each of the heater elements varies as $W/mm_1<W/mm_x<W/mm_N$, where $W/mm_1$ is the power density per unit length of the first heater element, $W/mm_x$ is the power density per unit length of an intermediate heater element, and $W/mm_N$ is the power density per unit length of the $N^{th}$ heater element.

8. The fuser roll of claim 7 wherein a plurality of intermediate heater elements similarly vary in power density per unit length relative to the voltage return, and wherein the farther the heater element from the return, the higher the power density per unit length.

* * * * *